US005967408A

United States Patent [19]

Garabedian

[11] Patent Number: 5,967,408

[45] Date of Patent: Oct. 19, 1999

[54] COMBINATION CIGAR HUMIDOR AND MINIATURE GOLF BAG

[76] Inventor: Thomas Garabedian, 4728 Robinhood Trail, Sarasota, Fla. 34232

[21] Appl. No.: 09/021,524

[22] Filed: Feb. 10, 1998

[51] Int. Cl.[6] ..... A24F 25/02

[52] U.S. Cl. ..... 236/44 R; 312/31; 131/329; 261/128; 30/142

[58] Field of Search ..... 312/31; 131/329; 236/44 R

[56] References Cited

U.S. PATENT DOCUMENTS

| | | | |
|---|---|---|---|
| 4,534,369 | 8/1985 | Jenkins | 131/235.1 |
| 4,934,524 | 6/1990 | St. Charles | 206/204 |
| 5,687,749 | 11/1997 | Brauer, Jr. | 131/329 |
| 5,884,632 | 3/1999 | Brauer, Jr. | 131/329 |
| 5,893,454 | 4/1999 | Hermanek | 206/255 |

*Primary Examiner*—Henry Bennett
*Assistant Examiner*—Mark Shulman
*Attorney, Agent, or Firm*—Charles J. Prescott

[57] ABSTRACT

A combination miniature golf club bag and humidor for cigars positioned centrally in the golf bag. The humidor carryall in the form of a miniature golf bag may be decoratively displayed when not in use, but all the while storing and humidifying cigars contained therein.

2 Claims, 5 Drawing Sheets

COMBINATION CIGAR HUMIDOR AND MINIATURE GOLF BAG

BACKGROUND OF THE INVENTION

1. Scope of Invention

This invention related generally to humidors and more particularly to a novel combination cigar humidor and miniature golf bag.

2. Prior Art

Cigar humidors are well known. Such devices are normally variously configured to provide a humidity regulated chamber for holding cigars.

The present invention provides a combination humidor and miniature golf bag uniquely configured to provide the appearance and feel of a miniature golf club bag for decorative carrying and storage of the humidor containing cigars.

BRIEF SUMMARY OF THE INVENTION

This invention is directed to a combination miniature golf club bag and humidor for cigars positioned centrally in the golf bag. The humidor carryall in the form of a miniature golf bag may be decoratively displayed when not in use, but all the while storing and humidifying cigars contained therein.

It is therefore an object of this invention to provide a cigar humidor configured to provide the appearance and handling feel of a miniature golf club bag.

It is another object of this invention to provide an easily carryable cigar humidor decoratively configured to simulate the appearance and feel of a miniature golf club bag.

It is yet another object of this invention to provide a combination cigar humidor and a miniature golf club bag for decorative storage and easy portability of the humidor.

In accordance with these and other objects which will become apparent hereinafter, the instant invention will now be described with reference to the accompanying drawings.

DETAILED DESCRIPTION OF THE INVENTION

Figure 1:
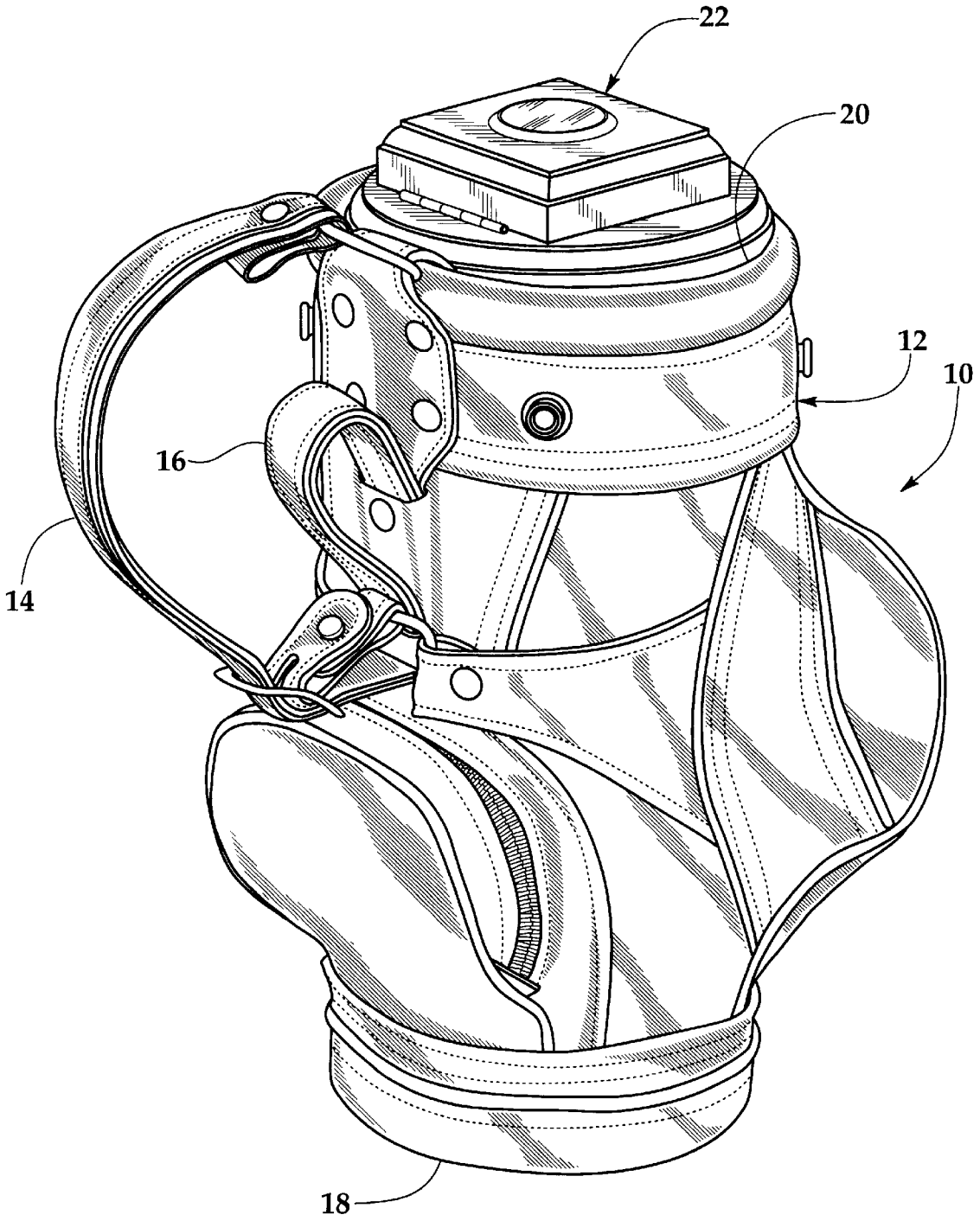
FIG. 1 is a right rear perspective view of the invention.

Referring now to the drawings, the invention is generally shown at numeral 10 in all views, the invention 10 generally including a carrying case 12 in the form of a miniature golf bag fabricated of pliant vinyl or leather panels and having two carryable handles 14 and 16. The invention 10 also includes a humidor 22 which is described in detail herebelow.

The golf bag 12 also includes a flat bottom or base 18 so that the golf bag may be decoratively stored for viewing in an upright orientation as shown. Thus, the device 10 may be displayed on a flat surface or easily carried by one of the two handles 14 and 16 without disturbing the contents of the humidor 22.

The golf bag 12 further includes an open generally cylindrical upper end 20 which is formed around and reinforced by a length of cylindrical plastic tubing which is internally attached to the surrounding exterior panels to define the miniature golf bag 12.

Figure 2:
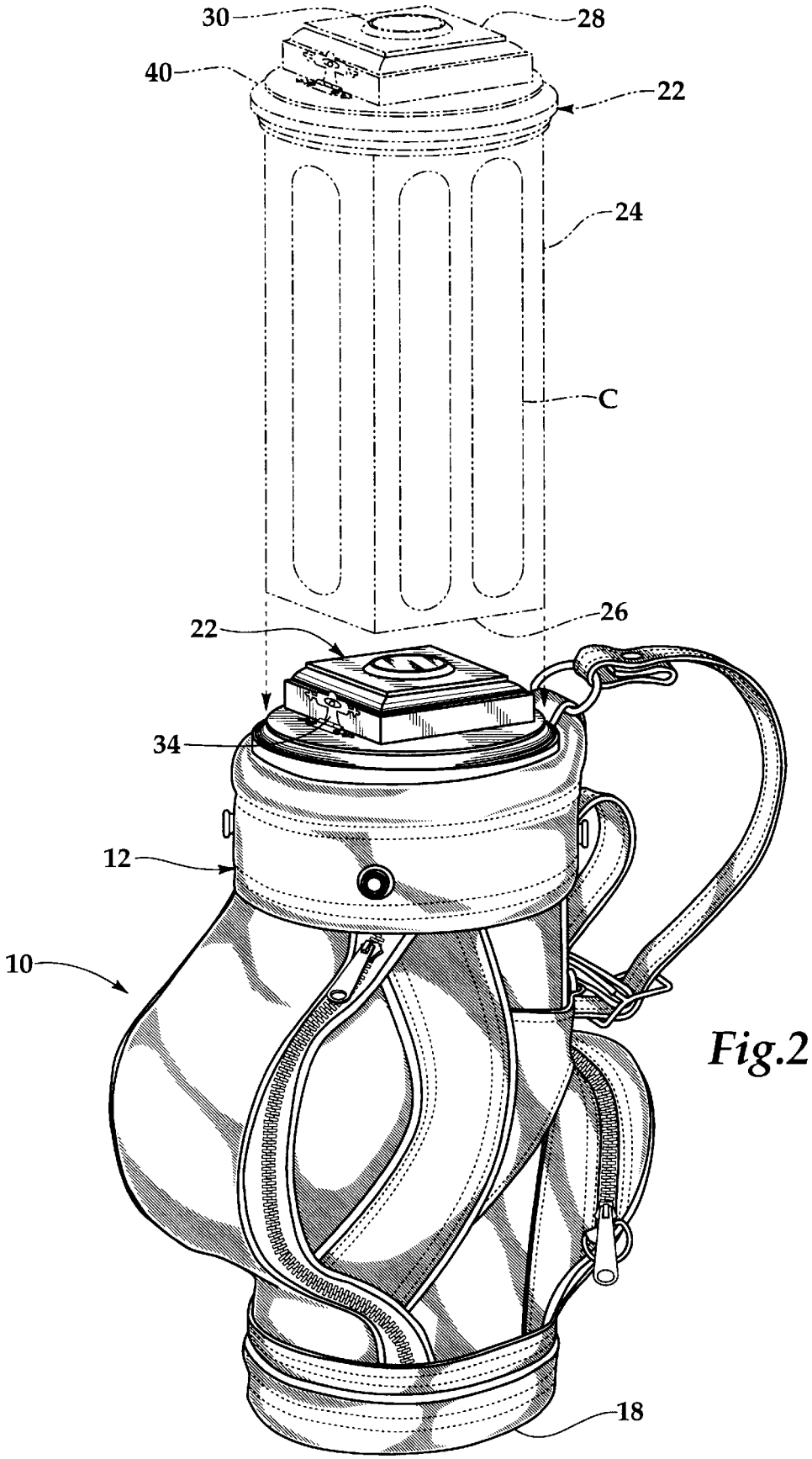
FIG. 2 is a left frontal perspective view of the invention showing the humidor exploded in phantom.
Figure 3:
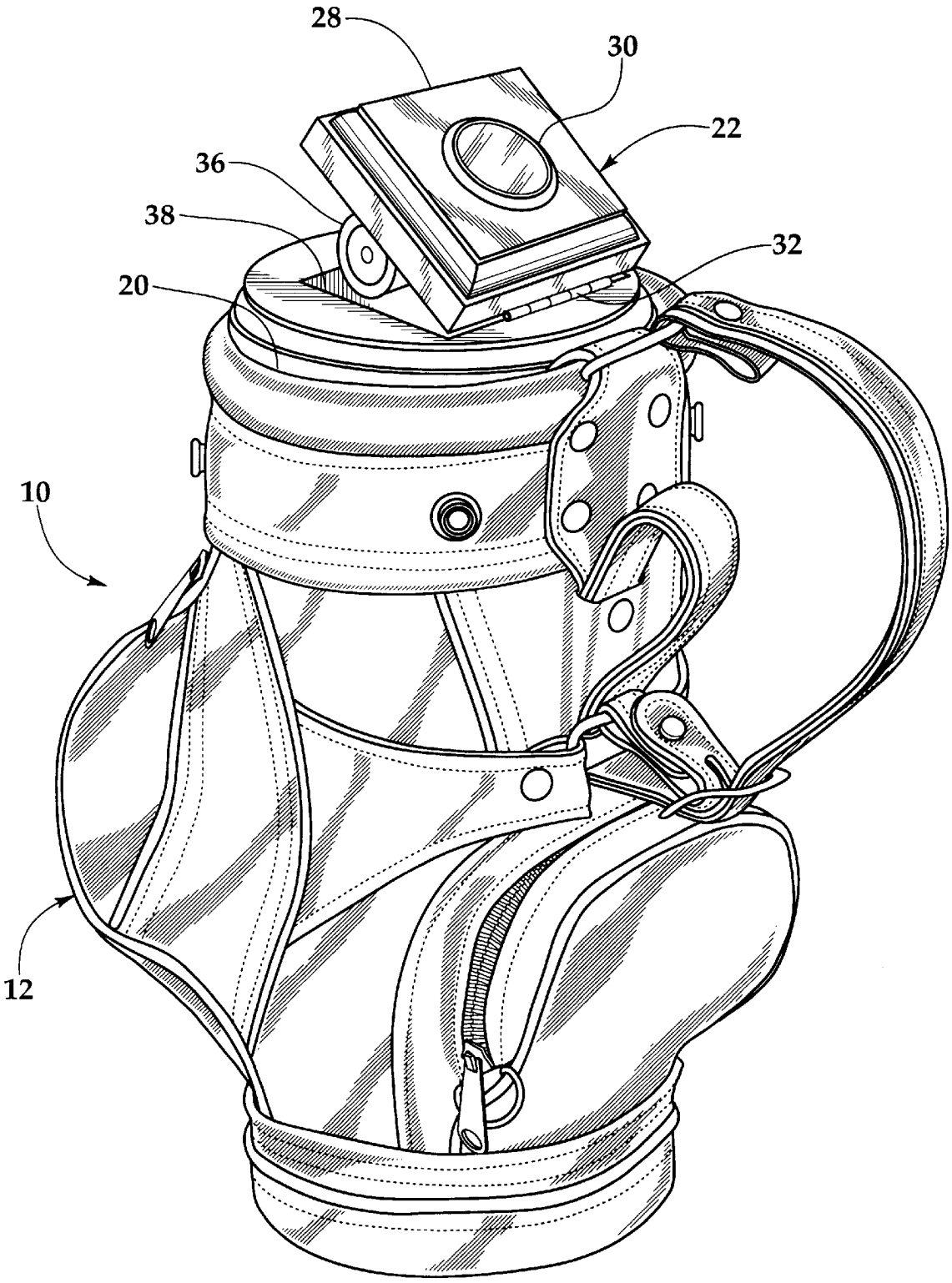
FIG. 3 is a left rear perspective view of the invention with the humidor top cover partially open.
Figure 4:
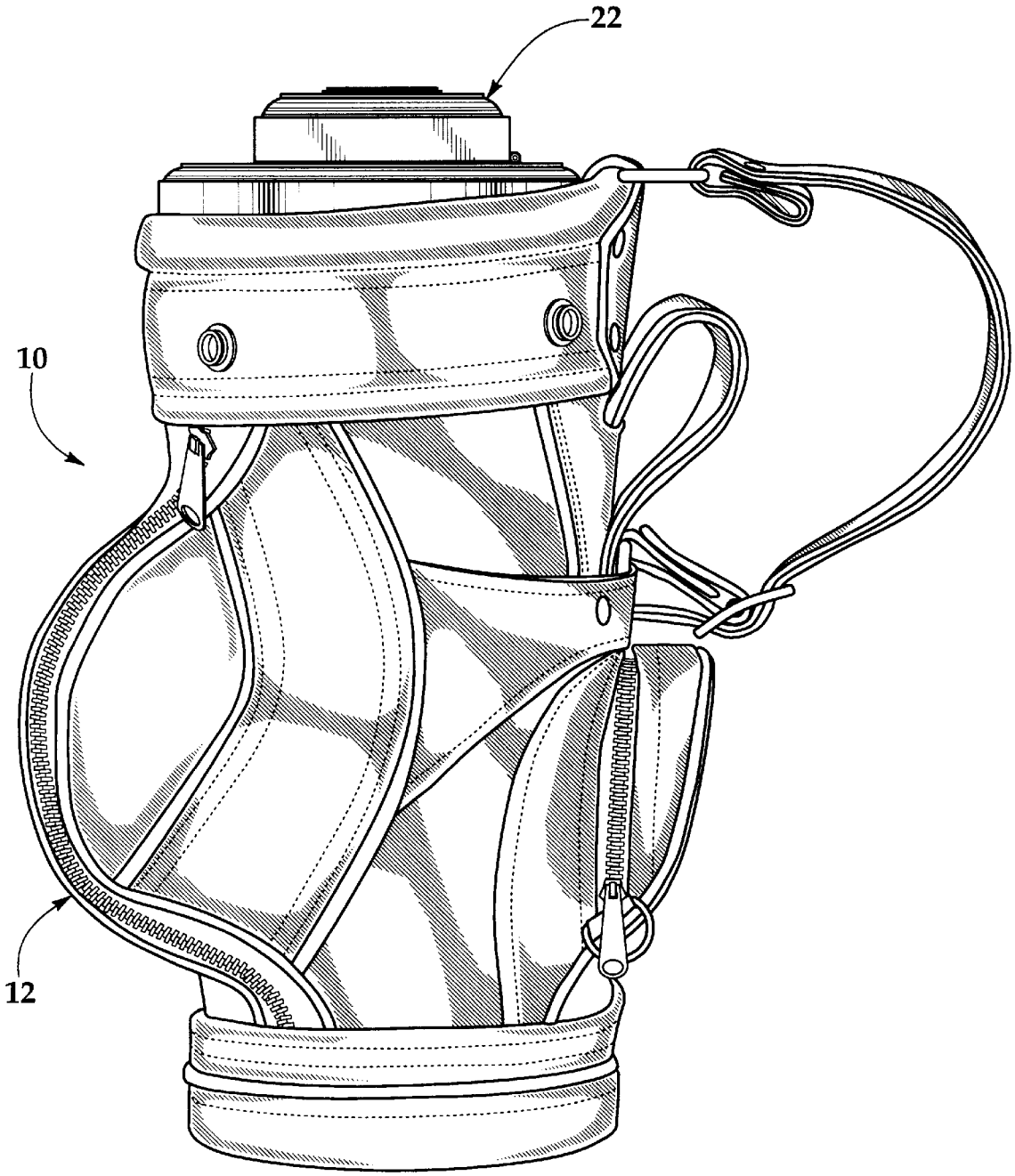
FIG. 4 is a left side elevation view of the invention.
Figure 5:
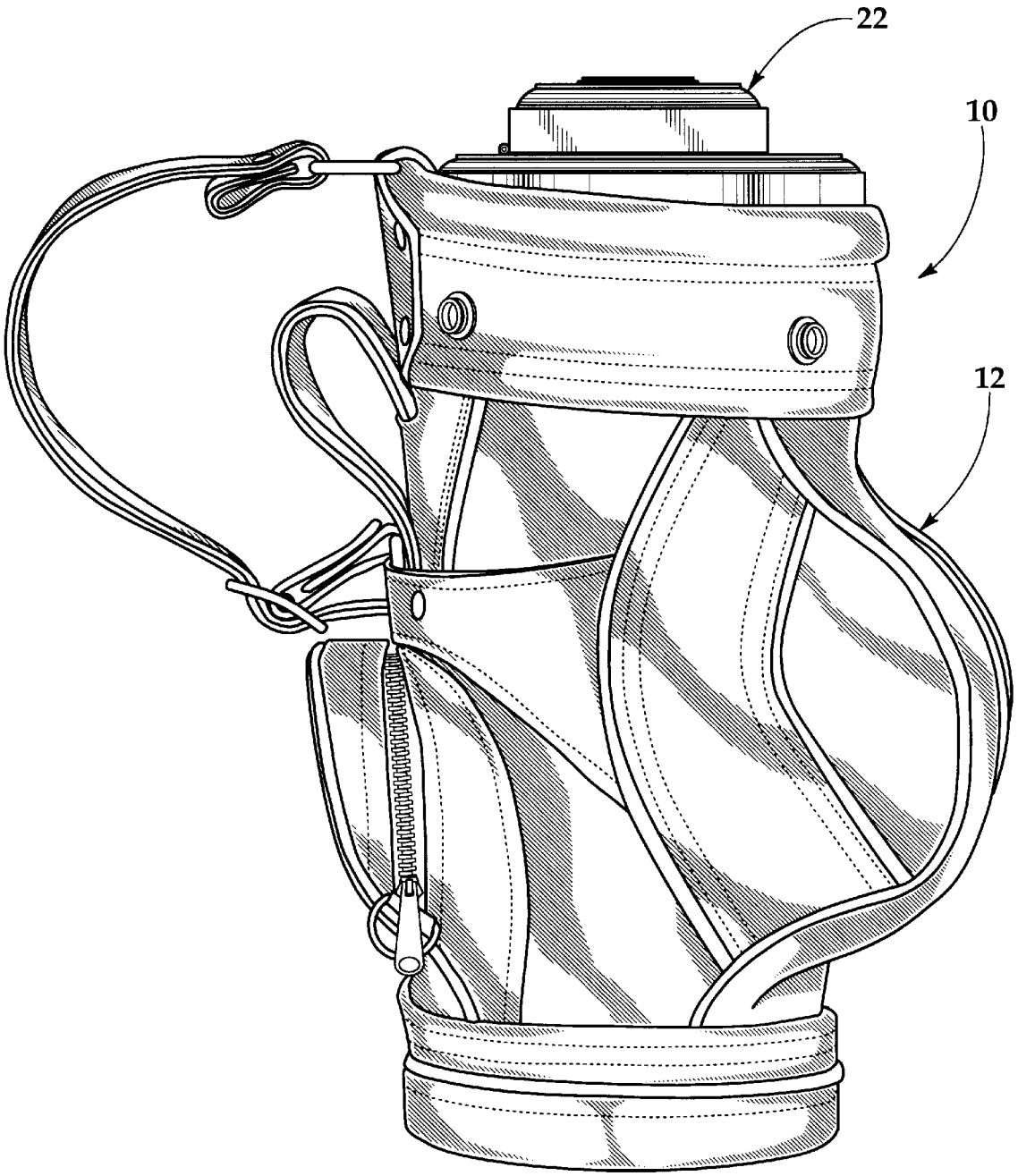
FIG. 5 is a right side elevation view of the invention.

As best seen in FIGS. 2 and 3, the humidor 22 is formed of an elongated generally rectangular wooden chamber 24 having a bottom thereof 26 which chamber 24 defines an interior volume sufficient to hold a quantity of cigars C. Other materials may also be used to form the humidor 22 such as plastic. An enlarged upper mounting flange 40 rigidly attached to the cigar chamber 24 defines an upper opening 38 which is substantially sealably closed when a lid 28, pivotally connected to flange 40 by hinge 32, is secured in the closed position by a clasp 34. Flange 40 is sized to tightly mateably engage within opening 20 to mechanically lock the humidor 22 into the position within the golf bag 12 when its bottom 26 is anchored to the bottom 18 of golf bag 12 shown in all figures.

To maintain a desired humidity level within the interior volume of the cigar chamber 24, a HUMISTAT 36 is connected to the bottom side of lid 28. This device is described in U.S. Pat. Nos. 3,431,038 and 4,428,892 and is manufactured and distributed under the HUMISTAT trademark by the Humistat Company of Forrest Hills, N.Y. This humidifier 36 regulates the delivery of moist air into the interior volume of the cigar chamber 24 as desired.

A conventional humistat 30 is mounted atop the lid 28 with a humidity sensor penetrating into the interior volume of the cigar chamber 24 when the lid 28 is closed. By this arrangement, the user may quickly view the level of humidity within the interior volume without the need for opening the humidor 22.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In combination, a cigar humidor and a miniature golf club bag comprising:

a miniature golf club bag having a main upright body open at an upper end thereof, a base for supporting said golf club bag in an upright orientation atop a surface and a carrying strap;

an upright humidor secured within said golf club bag and extending downwardly into said golf bag and upwardly from said golf club bag open upper end;

said humidor including an openable upper lid and sized in height to receive and hold cigars therein whereby, when said lid is closed, an interior volume of said humidor is substantially closed;

means for maintaining a predetermined level of humidity within said interior volume when said lid is closed to maintain a desired moisture content of the cigars.

2. A cigar humidor and miniature golf club bag and set forth in claim 1, further comprising:

means connected to said lid for sensing relative humidity within said interior volume and for displaying that relative humidity without the need for opening said lid.

* * * * *